US005697697A

United States Patent [19]

Cserteg et al.

[11] Patent Number: 5,697,697

[45] Date of Patent: Dec. 16, 1997

[54] DISCHARGE LAMP ASSEMBLY HAVING AN IMPROVED ADHESIVE ARRANGEMENT BETWEEN THE LAMP AND HOUSING

[75] Inventors: Erzsebet Cserteg; Jozsef Tokes; Istvan Wursching; Jozsef Fulop, all of Budapest, Hungary

[73] Assignee: General Electric Company, Schenectady, N.Y.

[21] Appl. No.: 607,530

[22] Filed: Feb. 27, 1996

[30] Foreign Application Priority Data

Feb. 27, 1995 [HU] Hungary ..... P9500589

[51] Int. Cl.[6] ..... F21S 3/00

[52] U.S. Cl. ..... 362/225; 362/260; 362/362

[58] Field of Search ..... 362/216, 217, 362/220, 221–225, 260, 362, 368

[56] References Cited

U.S. PATENT DOCUMENTS

| | | | |
|---|---|---|---|
| 3,808,495 | 4/1974 | Win | 362/223 |
| 4,661,890 | 4/1987 | Watanabe et al. | 362/217 |
| 4,754,375 | 6/1988 | Ferenc | 362/216 |
| 4,924,368 | 5/1990 | Northrop et al. | 362/260 |
| 5,285,361 | 2/1994 | McKillip | 362/216 |

*Primary Examiner*—Alan Cariaso

*Attorney, Agent, or Firm*—George E. Hawranko

[57] ABSTRACT

The cap according to the invention has a base plate and a side wall and in the base plate, openings are formed for accepting the glass body or bodies of the lamp envelope. Optionally, a partition is placed between the side wall and these openings. The essential feature of the invention is that the cap has, in its inner space bordered by the side wall, or optionally by the partition, components extending to at least one opening and bordering a smaller space at its side, the smaller space being intended to accept an adhesive and is also bordered by some portion of the base housing.

11 Claims, 3 Drawing Sheets

Fig. 3
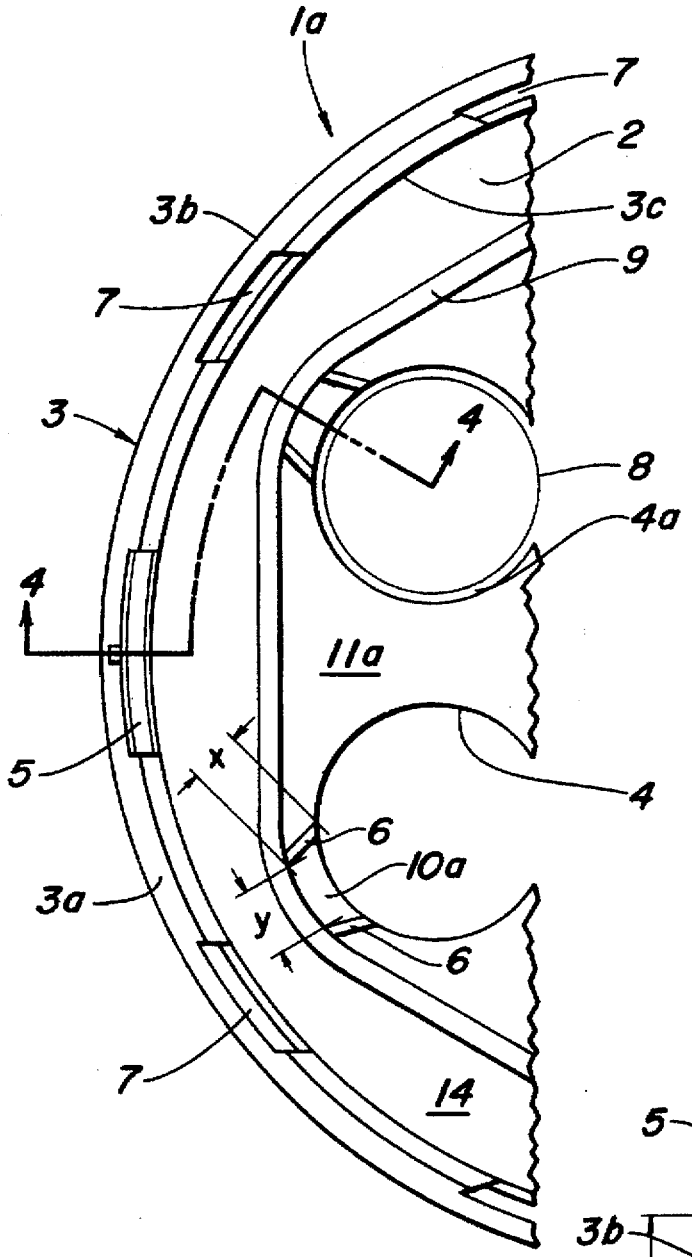
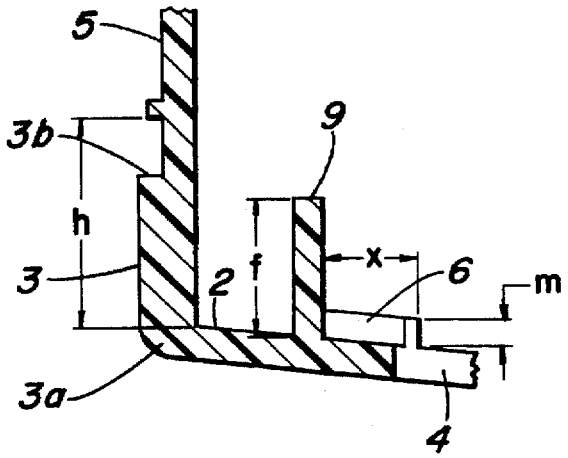
Fig. 4

Fig. 5
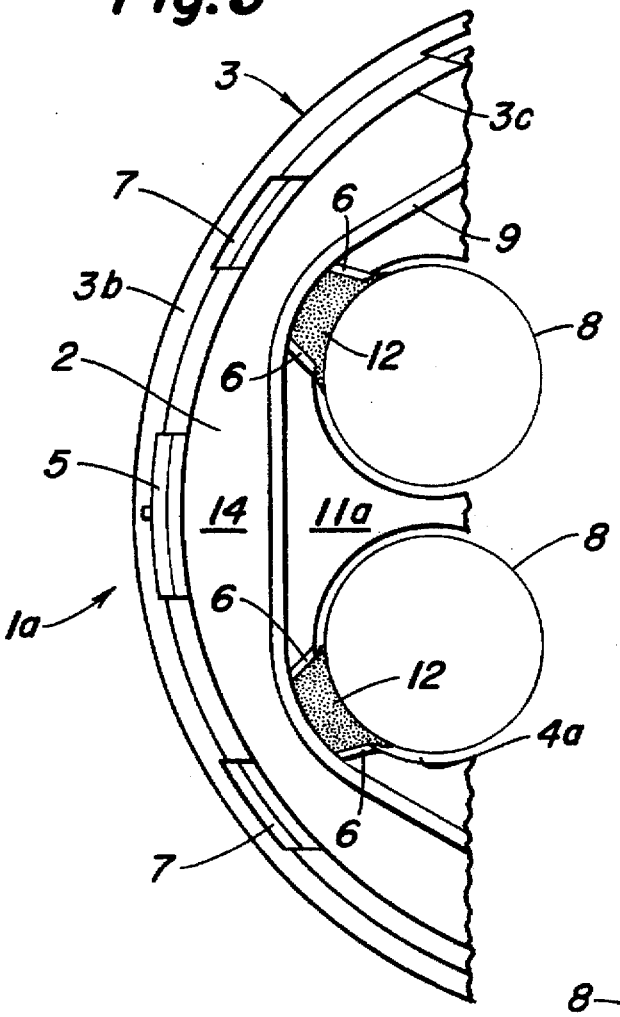
Fig. 6
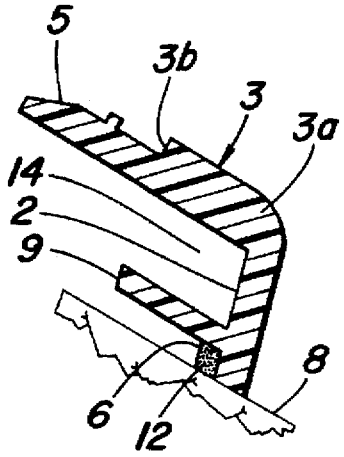
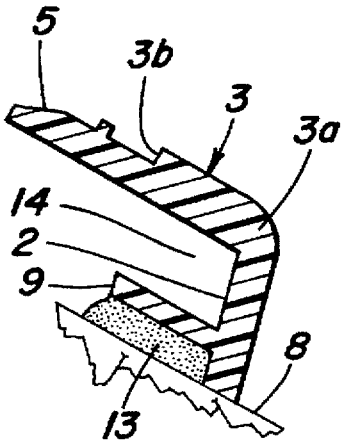
Fig. 8
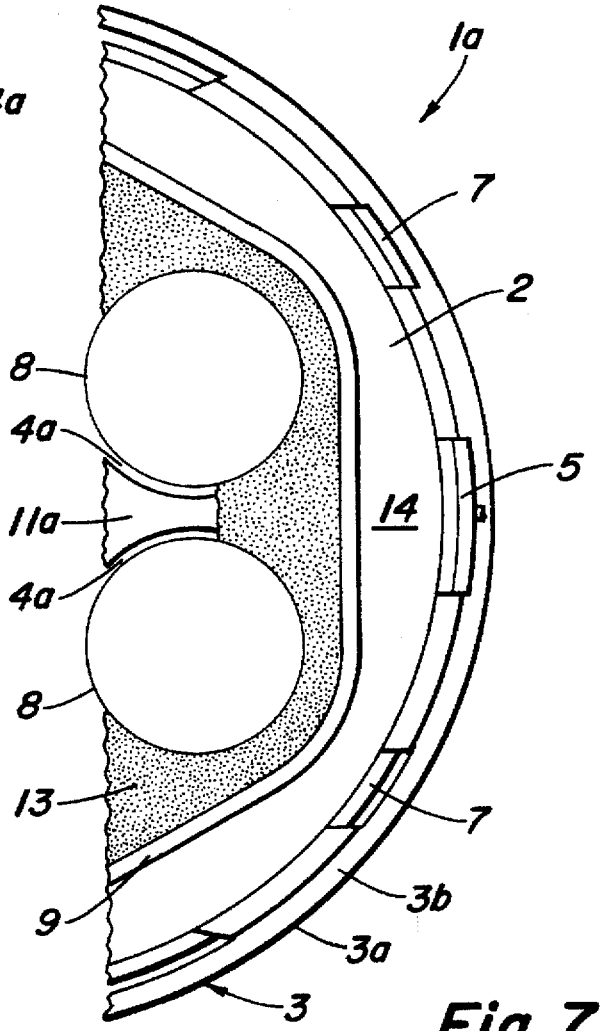
Fig. 7

DISCHARGE LAMP ASSEMBLY HAVING AN IMPROVED ADHESIVE ARRANGEMENT BETWEEN THE LAMP AND HOUSING

FIELD OF THE INVENTION

This invention relates to a low pressure discharge lamp having a housing configuration that allows for a secure connection of the lamp envelope to the base housing of the lamp. The invention further relates to a lamp cap having a base plate and a side wall, and in the base plate, opening(s) is (are) formed to accept the glass body or bodies of the lamp.

BACKGROUND OF THE INVENTION

It is known that some types of light sources, primarily discharge lamps, e.g., compact fluorescent lamps have a housing, to which a base that fits to a lampholder is connected, and an electronic unit, is placed in case of some types in the housing. The side of the housing placed opposite to the base is closed by a cap intended, among others, to give orientation to and secure the glass body.

Presently, the caps are fixed to the glass body by means of a basing cement being used in the light source industry, and the caps are formed by taking this into account. The caps have a base plate comprising openings for passing the glass part of the lamp and a side wall connected to the rim of the base plate in perpendicular direction to the base plate. The inner space of the cap is wholly or partly filled up with the basing cement that, by sticking on one part to the inner surfaces of the cap, and to the outer surface of the glass body on the other, ensures that the latter is fixed to the cap in the designed position. In case of lamps where the side wall of the cap is relatively far from the opening(s) for passing the glass body, an annular-shaped inner rib (extending along a full circle), i.e., a partition is used which is placed inside the side wall with a spacing from it and is concentric to the side wall. In this case, only the portion of the cap being inside this partition is filled up with the basing cement that fixes the glass body.

Fixing with the basing cement has the disadvantage that the cement, after being used for a length of time, leaves the cap made mostly of a plastic material. This is explained by the fact that, exposed to the heat produced during the operation of the discharge tube and also to the UV radiation emitted by the discharge tube, the bond between the cap and the basing cement gets weaker as a consequence of disintegration of the cement. The existence of all these factors cause the hazard of falling-out of the glass body from the cap when exposed even to a slight mechanical load arising, e.g., in lamp replacement. The bond made with a basing cement has a further disadvantage of requiring a treatment of relatively high temperature for curing.

For performing fixing tasks in the light source industry, various adhesives are used that are more easily applied to the place of destination than a basing cement, and their lifetime is longer and the bond they produce withstands torsion and tensile loads appearing between the glass and the plastic material better than a basing cement does. However, the condition for the suitability of such, e.g., liquid or thixotrope adhesives is that parts of the discharge lamp to be stuck together have a construction of special design. Nevertheless, cases of application may exist in which the cheaper basing cement is also suitable for performing the (e.g. less demanding) task. Due to the fact that the manufacturing process conversion to the use of an adhesive requires a new equipment and much time, it may be also desirable to keep the possibility for sticking with a basing cement at the same time when using this manufacturing process utilizing an adhesive material.

SUMMARY OF THE INVENTION

The objective of the invention is to provide a cap suitable for connection to the glass body of practically any lamp type, which cap is appropriate for fixing to the glass body, both with the conventional basing cement and with some up-to-date adhesive material.

The invention is based on the recognition that inside the cap, spaces of small size compared to the volumes of the whole cap and of the basing cement can be localized by means of ribs not hindering the basing cement from being applied and spread, which spaces, by being filled up with the basing material provide for a safe and permanent joint between the glass body and the cap.

Based on the above recognition, the objective of the invention is achieved by means of a cap construction that has a base plate and side wall and opening(s) is (are) formed in the base plate to accept the glass body or bodies of the lamp and which cap construction is characterized in that the cap has, in its inner space bordered by the side wall, components extending to at least one opening and bordering a smaller space at its side, the smaller space being intended to accept an adhesive and is also bordered by some portion of the cap.

A preferred embodiment of the cap is characterized in that the components bordering the space(s) being intended to accept an adhesive are constructed as ribs placed between the opening(s) and the side wall with spacings, protruding from the base plate and oriented in a direction crossing the side wall. The ribs preferably start immediately from the rims of the opening(s) and are connected to the side wall. The invention also relates to a cap having a base plate and a side wall, and opening(s) is (are) formed in the base plate to accept the glass body or bodies of the lamp, and between these openings and the side wall, a partition is placed. The essential feature of this type of cap is that the cap has, in its inner space bordered by the partition, components extending to at least one opening and bordering a smaller space at its side, the smaller space being intended to accept an adhesive is also bordered by some portion of the cap. The ribs preferably start immediately from the rims of the opening(s) and are connected to the partition.

The discharge lamp according to the invention has a glass body with one or more tube members, a housing belonging to this glass body and provided with a base suitable for being connected to a lampholder, and also having a cap connected to the housing, which cap has a base plate to accept the tube member or members of the glass body. The essential feature of this discharge lamp is that the cap has, in its inner space bordered by the side wall, components extending to at least one opening and bordering a smaller space at its side, the smaller space being intended to accept an adhesive is also bordered by some portion of the cap. The components bordering the space(s) being intended to accept an adhesive are preferably constructed as ribs placed between the opening(s) and the side wall with spacings, protruding from the base plate and oriented in a direction crossing the side wall, and the ribs preferably start immediately from the rims of the opening(s) and are connected to the side wall.

Another discharge lamp according to the invention has a glass body with one or more tube members, a housing belonging to this glass body and provided with a base suitable for being connected to a lampholder, and also having a cap connected to the housing, which cap has a base plate and a side wall, and in the base plate, opening(s) is (are) formed to accept the tube member or members of the glass body, and a partition is placed between these openings and the side wall, and the essential feature of the discharge lamp is that the cap has, in its inner space bordered by the partition, components extending to at least one opening and bordering a smaller space, the smaller space being intended to accept an adhesive is also bordered by some portion of the cap. The components bordering the space(s) being intended to accept an adhesive are preferably constructed as ribs placed between the opening(s) and the side wall with spacings, protruding from the base plate and oriented in a direction crossing the side wall. In addition, the ribs preferably start immediately from the rim of the opening(s) and are connected to the partition.

With all solutions described above, the height of the ribs in the cap is at least 0.5 mm, preferably 1 to 3 mm, and the spacing between them amounts to 1.5 to 3.0 times, preferably about twice their length. It is to be noted that the ribs should not necessarily extend to the side wall or the partition; if they just do not reach it, the only difference will be that a small amount of adhesive will spill through the gap, a consequence not affecting adversely the safety of fixing, moreover, the surface of adhesion will even increase to a small extent.

The pairs of ribs can be oriented in parallel direction to each other and directed radially. They can also be, however, radially convergent or outwardly convergent. The ribs are preferably made to form one member with the whole, e.g., injection-molded plastic cap.

BRIEF DESCRIPTION OF THE DRAWINGS

In the following, the invention will be described in details illustrated by the figures attached that show the preferred embodiments of the cap. In the drawings:

FIG. 3 illustrates a detail of a six-member (HEX-type) compact fluorescent lamp Comprising the cap according to the invention in a view directed towards the inside of the cap.

FIG. 4 is a section taken along the line 4—4 indicated in FIG. 3.

FIGS. 5 and 6 show the construction according to FIGS. 3 and 4, after fixing with the adhesive material.

In FIGS. 7 and 8, the same constructions are seen as those according to FIGS. 3 and 4, here, however, the discharge tube and the cap are fixed to each other with a basing cement.

DETAILED DESCRIPTION OF THE INVENTION

Figure 1:
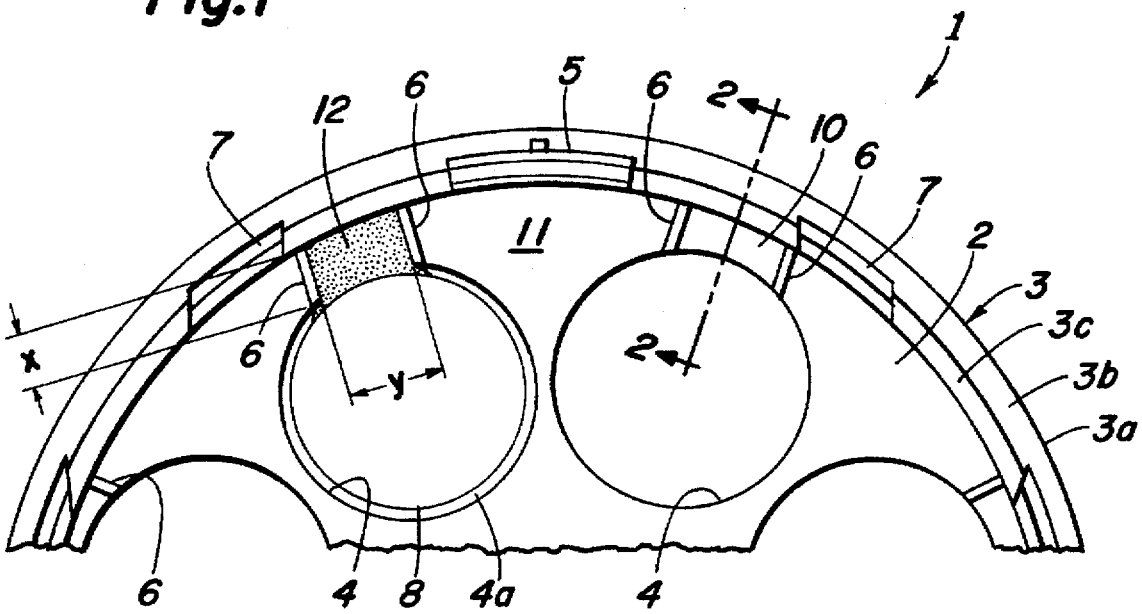
FIG. 1 shows a detail of an eight-member (OCT-type) compact fluorescent lamp comprising the cap according to the invention, in a view directed towards the inside of the cap.
Figure 2:
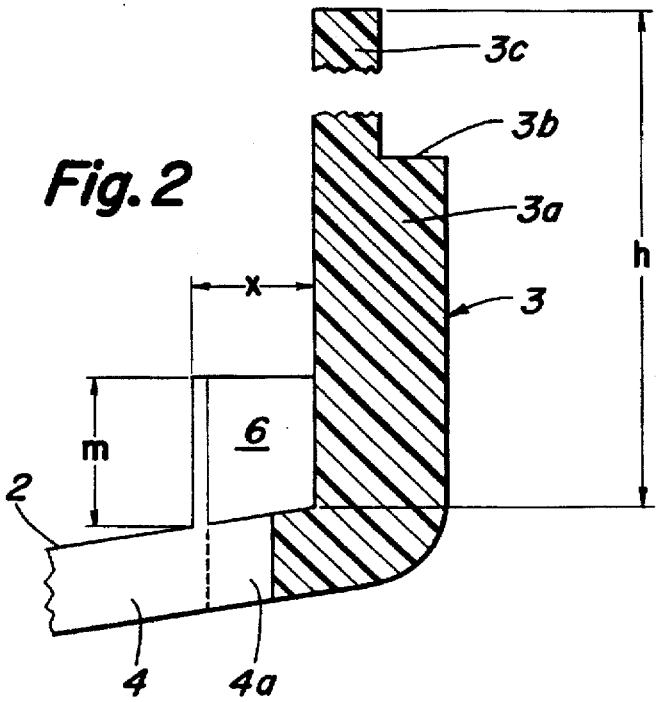
FIG. 2 is a section of a larger scale taken along the line 2—2 indicated in FIG. 1.

In FIG. 1, the housing having reference number 1 as a whole has a circular-shaped base plate 2 that comprises eight circular openings 4 along its cylindrical side wall placed along and being perpendicular to the base plate 2. The housing 1 is a component of an OCT-type compact fluorescent lamp having eight glass bodies or tube member 8, of which only one is shown for better illustration. Adjacent tube members 8 may form a portion of a lamp envelope which defines a closed, contiguous discharge space. Alternatively, the tube members 8 may form one contiguous lamp envelope with the tube members 8 intersecting proximate the base plate. In order to provide a complete description, in FIG. 1 seats 7 not being in direct relationship to the essential features of the invention, still serving for the connection with the other parts of the compact fluorescent lamp and indented into the thinner wall portions 3*c* of side wall 3 are shown. Positioning tabs 5 protruding from this same wall portion 3*c* and needed for applying the basing cement and performing the operation of sticking, is also shown here. As seen in FIG. 2, an outer shoulder 3*b* extending along a full circle is formed where the thicker 3*a* and the thinner 3*c* portions of the side wall 3 meet. The overall height of the side wall 3 is denoted with reference h in FIG. 2.

According to the invention, in the space between each of the openings 4 and the inner surface of the side wall 3, ribs 6 are placed, two ribs 6 for each opening 4, which ribs 6 protrude upwards from the surface of base plate 2. Each pair of ribs 6 border a space 10 with each other, which space 10 is open upside. The height m of ribs 6 (see FIG. 2) is chosen so that they localize the spread of the adhesive in lateral direction and ensure the coating thickness needed for effectively fixing tube member 8 to side wall 3. The height m of the ribs 6 (see FIG. 2) is chosen so that they localize the spread of the adhesive in lateral direction and ensure the coating thickness needed for effectively fixing tube member 8 to side wall 3. The height m of the ribs 6 is to be chosen so small that, in the case when for producing a connection between the glass tube and the housing a conventional basing cement is used rather than an adhesive material, it does not prevent the cement from spreading in space 11 and fills completely this space, since the basing cement is supplied into housing 1 from one single valve. The space 11 indicated in FIG. 1 is interpreted as the whole space bordered by the side wall 3 and the tube members 8 passed through the openings 4. In practice, the height m of ribs 6 is minimum 0.5 mm and is preferably between 1 and 3 mm. The length of the ribs 6 can be 1 to 2 mm while their distance y from each other is to be practically chosen by taking into consideration that caused by the bow of the tube members 8, increasing this distance would greatly increase the area between the two ribs 6. This is not necessary since, due to the excellent adhesion properties of the adhesives to be used, these materials are required in a minimum quantity only to ensure the desired effect. In practice the distance y between the ribs 6 can be 1.5 to 3 times, preferably about twice their length X, i.e. y=(1.5 to 3) X preferably y=2X. The pairs of ribs 6 are, in case of the embodiment according to FIG. 1 are parallel to each other and are approximately directed radially, but a different arrangement is also conceivable.

Thus, if the connection between the tube members 8 of the lamp envelope and the housing 1 is intended to be produced by making use of an adhesive material, exclusively the space 10 between each pair of ribs 6 will be filled up with this material. In FIG. 1, the tube member 8 of the lamp envelope, placed in one of the openings 4 of cap 1 is also shown and the adhesive material that fills up the space 10 is denoted with reference number 12. It is clearly seen in FIG. 1 that the adhesive material 12 is, in addition to the inner surfaces of ribs 6, in contact with the inner surface of the side wall 3 and the outer surface of the tube member 8, and slightly flows into gap 4*a* between the tube member 8 and the opening 4 also, and in this way a firm and reliable connection will be produced quite safely between the tube member 8 and the housing 1. During the operation of attachment/securing the lamp envelope is oriented with its domed portion downwards, thus the ends of its tube members 8 are extending upwards, and the housing 1 is placed on these tube ends so that its side wall 3 is oriented upwards. The operation of attachment/securing results in a non-continuous but completely safe bond produced separately at each tube member 8 by consuming minimum quantity of adhesive material 12.

If the joint between the tube members 8 and the housing 1 is desired to be provided by means of a conventional basing cement, the space 11 is filled up partly or wholly with the basing cement so that it surrounds each tube member 8 in the housing 1. The basing cement will be able to be in contact with the inner surface of side wail 3 over its entire length since its spread is not hindered by the very low ribs 6. Moreover, the efficiency of sticking with the basing cement is improved even by these ribs 6 because they increase the surface available for adhesion.

In FIGS. 3 through 8, the embodiment of the housing according to the invention suitable for being used in a compact fluorescent lamp with six tube members (HEX-type) is illustrated. This housing as a whole is denoted with reference number 1*a*. Since the housing 1*a* has the same basic construction as the housing 1 according to FIGS. 1 through 3, the identical parts of the construction are denoted with the corresponding reference numbers used previously. The difference is that in case of the housing 1*a*, the openings 4 for accepting the tube members 8 of the lamp envelope are substantially more remote from the side wail 3 than in case of the housing 1. Therefore, both of the basing cement and of the adhesive material, higher quantities would be needed. In order to reduce significantly the volume to be filled up with the adhesive material or the basing cement, an inner, rib-like partition 9 extending along a full circle and having a contour of a closed curve is formed inside the housing 1*a* along the openings 4. The partition 9 follows the positions of the openings 4, instead of having the shape of a circular annulus, which results in that groove 14 between the partition 9 and the side wall 3 which groove 14 adhesive material or basing cement will not enter, has a varying width and space 11*a* inside the partition 9 has a minimum volume. The pairs of short ribs 6 oriented in a direction crossing the inner partition 9 extending along a full circle are placed in this case in the space between each opening 4 and the inner surface of this partition 9, and each pair of short ribs borders one outwardly narrowing space 10*a*. Thus, in this case the ribs 6 are, differently from the case of the housing 1 seen in FIG. 1, not parallel to each other but are outwardly convergent. In this example also, the height of the ribs 6 is denoted with m, the minimum spacing between each pair of fibs, with y and the length of the ribs 6, with X. It is seen in FIG. 4 that the height f of the partition 9 is smaller than the height h of the side wall 3 (see also FIG. 2), and this smaller height f is to be chosen by taking into consideration the requirement for the possibility of dosing a quantity of basing cement sufficient for a safe fixing in case when a basing cement is used for fixing.

There is illustrated in FIGS. 5 and 6, how tube members 8 of the lamp envelope are, e.g., with a liquid adhesive material, fixed to the housing 1*a*. It is seen clearly in these figures that the adhesive material 12 fills up the spaces 10*a* only, so it locally contacts the outer surfaces of each tube member 8 on one part and, the inner surfaces of the partition 9 and of the ribs 6 oriented in a direction crossing it on the other. In this case also, the adhesive material 12 enters the gaps 4*a* which results in an increase of the surface available for adhesion. In case of the solution according to FIGS. 7 and 8, the tube members 8 of the lamp envelope are fixed to this same housing 1*a* by making use of a basing cement. According to FIG. 8, the basing cement 13, by filling up the whole space 11*a*, surrounds the tube members 8 nearly completely and contacts the inner surface of the rib 9 along its entire length; and in the upward direction, as seen in FIG. 8, extends to the portion of the upper rim of the partition 9.

The advantages related to the invention are as follows. The housing according to the invention can be used universally for any type of discharge tubes. This includes its utilization in compact fluorescent lamps by making use of whether a conventional cheaper basing cement or a somewhat more expensive adhesive material that has longer life and provides a bond between glass and plastic material which bond has higher resistance both to tensile and torsion loads. Consequently, adaptation is possible to both kinds of the manufacturing process by using one single type of housing which enables an immediate changeover to the manufacturing process appropriate for the actual needs and the optimization of production costs (taking into account that making the plastic cap requires less injection-molding tooling and parts). In addition, a gradual changeover to fixing with an adhesive material is also enabled, by keeping the fixing with basing cement during the changeover. It is a further advantage that the outside diameter of the housing can be reduced to a value determined by the enveloping surface bordered by the tube members of the lamp envelope and the wall thickness of the housing which results in a saving of plastic material. The adhesion surface confined exactly by the ribs enables a perfect fixing with consuming the smallest possible quantity of the relatively expensive adhesive material, and also, when a basing cement is used, its surface available for adhesion is increased by the ribs. The quantity of adhesive material consumed can also be reduced by leaving out from the fixing operation some of the tubes passing the base plate of the housing; this may be allowable due to the strength of the bond.

The invention, of course, is not limited to the examples of embodiments described above in details; it can be implemented in several ways within the scope of protection defined by the claims.

What is claimed is:

1. A low pressure gas discharge lamp including a lamp housing having a base plate, a side wall extending from and cooperating with the base plate to define a housing inner portion, at least one opening formed in the base plate, and an end of a lamp envelope extending through the opening, wherein the improvement comprises:

a first base plate rib extending from the opening within the inner portion; and a second base plate rib extending from the opening within the inner portion and spaced apart from the first rib, the first and second ribs defining a bounded area therebetween for localizing an adhesive material which secures the lamp envelope to the housing.

2. The discharge lamp according to claim 1, wherein the first and second ribs extend between the opening and a partition spaced radially inwardly from the side wall.

3. The discharge lamp according to claim 1, wherein the first and second ribs extend between the opening and the side wall.

4. The discharge lamp according to claim 1, wherein a height (m) of the first and second ribs is at least 0.5 mm and a distance (y) between the first and second ribs is 1.5 to 3.0 times a length (x) of the first and second ribs.

5. The discharge lamp according to claim 4, wherein the distance (y) between the first and second ribs is about twice the length (x) of the first and second ribs.

6. The discharge lamp according to claim 1, wherein the first and second ribs are parallel to each other.

7. The discharge lamp according to claim 1, wherein the first and second ribs are convergent in a radially outward direction from the opening.

8. A discharge lamp comprising:

a housing;

a cap secured to the housing and having a base plate, a side wall extending from and cooperating with the base plate to define an inner portion, and at least one opening extending through the base plate for receiving an end of a tube member associated with a lamp envelope;

a first base plate rib extending from the opening within the inner portion; and a second base plate rib extending from the opening within the inner portion and spaced apart from the first rib, the first and second ribs defining a bounded area therebetween for localizing an adhesive material which secures the lamp envelope to the cap.

9. The discharge lamp according to claim 8, wherein the first and second ribs extend between the opening and a partition spaced radially inwardly from the side wall.

10. A discharge lamp comprising:

a housing;

a cap secured to the housing and having a base plate, a side wall extending from and cooperating with the base plate to define an inner portion, and at least one opening extending through the base plate for receiving an end of a tube member associated with a lamp envelope;

a partition joined to the cap within the inner portion and spaced radially inwardly from the side wall a first base plate rib extending between the partition and the opening within the inner portion and a second base plate rib extending between the partition and the opening within the inner portion and spaced apart from the first rib, the first and second ribs cooperating to define a bounded area therebetween for localizing an adhesive material which secures the lamp envelope to the cap.

11. The discharge lamp according to claim 8, wherein the first and second ribs extend between the opening and the side wall.

* * * * *